US005853538A

United States Patent [19]

Reiner

[11] Patent Number: 5,853,538

[45] **Date of Patent: *Dec. 29, 1998**

[54] METHOD OF PRODUCING A NONWOVEN MATERIAL AND NONWOVEN MATERIAL PRODUCED ACCORDING TO THE METHOD

[75] Inventor: Lennart Reiner, Matfors, Sweden

[73] Assignee: SCA Hygiene Paper AB, Göteborg, Sweden

[ * ] Notice: The term of this patent shall not extend beyond the expiration date of Pat. No. 5,720,851.

[21] Appl. No.: 750,864

[22] PCT Filed: Jul. 12, 1995

[86] PCT No.: PCT/SE95/00847

§ 371 Date: Jan. 15, 1997

§ 102(e) Date: Jan. 15, 1997

[87] PCT Pub. No.: WO96/02701

PCT Pub. Date: Feb. 1, 1996

[30] Foreign Application Priority Data

Jul. 13, 1994 [SE] Sweden ..... 9402468
Jul. 13, 1994 [SE] Sweden ..... 9402470

[51] Int. Cl.[6] ..... D21H 13/00; D21H 25/16

[52] U.S. Cl. ..... 162/101; 162/190

[58] Field of Search ..... 162/101, 115, 162/146, 190, 204, 289, 301, 264

[56] References Cited

U.S. PATENT DOCUMENTS

| | | | |
|---|---|---|---|
| 4,443,297 | 4/1984 | Cheshire et al. | 162/101 |
| 4,488,932 | 12/1984 | Eber et al. | 162/9 |
| 4,498,956 | 2/1985 | Cheshire et al. | 162/101 |
| 5,102,501 | 4/1992 | Eber et al. | 162/129 |
| 5,106,457 | 4/1992 | Manning | 162/115 |

FOREIGN PATENT DOCUMENTS

| | | |
|---|---|---|
| 841938 | 5/1970 | Canada . |
| 1329409 | 9/1973 | United Kingdom . |

*Primary Examiner*—Peter Chin
*Assistant Examiner*—Steven B. Leavitt
*Attorney, Agent, or Firm*—Burns, Doane, Swecker & Mathis, L.L.P.

[57] ABSTRACT

Method of producing a nonwoven material by hydroentangling of a fiber web, whereby dry fibers, natural and/or synthetic, are metered into a dispersion vessel, possibly after pre-wetting. The fibers are dispersed in a foamable liquid including water and a tenside for forming a foamed fiber dispersion, which is applied to a wire and drained. The formed fiber web is subjected to hydroentangling directly after forming and the foamable liquid, after having passed through the wire, is recirculated to the dispersion vessel in a simple closed circuit.

12 Claims, 2 Drawing Sheets

METHOD OF PRODUCING A NONWOVEN MATERIAL AND NONWOVEN MATERIAL PRODUCED ACCORDING TO THE METHOD

FIELD OF THE INVENTION

The present invention relates to a method of producing a nonwoven material by hydroentangling a fibre web, and to a nonwoven material produced according to the method.

BACKGROUND OF THE INVENTION

Hydroentangling or spunlacing is a technique which was introduced in the 1970's, see e.g. CA patent No. 841,938. The method involves forming a fibre web, either dry-laid or wet-laid, whereafter the fibres are entangled, i.e. tangled together by means of very fine water-jets under high pressure. A plurality of rows of water-jets are directed at the fibre web which is supported by a moving wire. The entangled fabric is then dried. The fibres which are used in the material can be constituted by staple fibres, e.g. polyester, rayon, nylon, polypropylene and the like, by cellulosic fibres or by mixtures of cellulosic and staple fibres. Spunlace material can be produced cheaply and presents high absorption characteristics. Amongst other things they are used as drying materials for households or industrial use and as disposable materials within the field of health-care etc.

Foam-forming techniques, i.e. where a fibre web is formed from a dispersion of fibres in a foamed liquid, are used today for the production of paper and other fibre-based nonwoven materials as well as for the production of glass-fibre mats for compression molding of various products for use within i.a. the car industry. The technique is described i.a. in GB 1.329,409 and U.S. Pat. No. 4,443,297. The thus-produced fibre webs present a high degree of uniformity in the fibre forming.

A method of forming a hydroentangled nonwoven fabric is disclosed in U.S. Pat. No. 5 106 457 in which a foamed fibre furnish is formed by dispersing fibres in a foamed liquid comprising water and a surface active agent, as described in U.S. Pat. No. 4 498 956, and thereafter subjecting the thus formed web to a hydroentanglement step.

OBJECT AND FEATURES OF THE INVENTION

An object of the present invention is to achieve a simplified method of producing a nonwoven material with high absorption characteristics, strength and uniformity.

This object is achieved by a method according to claim 1.

By this method, a flexible, space-saving and energy-economical process has been achieved, with which spunlace material of a surprisingly high quality can be produced.

DESCRIPTION OF THE DRAWINGS

The invention will now be described in more detail with reference to two embodiments shown in the accompanying drawings.

DESCRIPTION OF EMBODIMENTS

Figure 1:
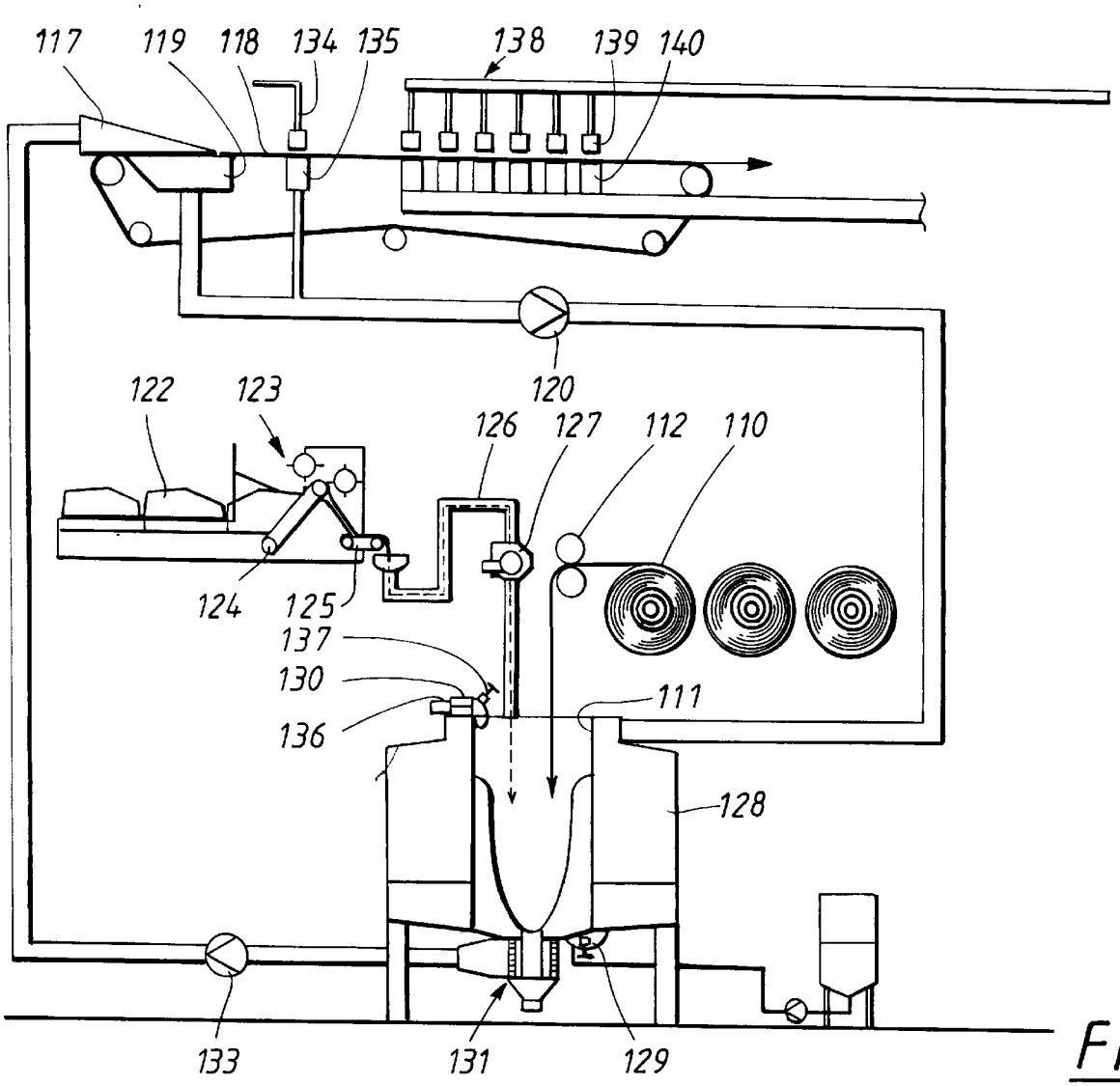
FIG. 1 is a flow diagram of the method according to the invention.

FIG. 1 shows a process solution for a foam forming process according to the invention. The foam is generated by means of a tenside being added to the water in a pulper 111 where an intensive agitation and air intake occurs. Additional foam generation occurs in the process due to the turbulence which is created in the pumps as well as at the wire 118. A condition for foam generation is however that there is access to air.

The tenside can be of any suitable type; anionic, cationic, non-ionic or amphoteric. GB patent 1,329,409 describes tensides suitable for foam forming of fibre webs. There are however many other available tensides suitable for the purpose. The choice of tenside can for example be affected by factors like the chemical composition of possible other additives to the fibre furnish, like wet-strengtheners, binders, creping chemicals, etc.

A suitable tenside metering in order to achieve a relatively stable foam which is able to maintain a substantially uniform dispersion of fibres in the foam is adjusted for each individual case and is dependent on such factors as the type of tenside, the degree of hardness of the water, the water temperature as well as the type of fibres. A suitable tenside content in the water lies within the range 0.02–1.0 weight-%, preferably however below 0.2 weight-%.

The characteristics of the foam vary with the amount of bound air. At an air content of up to about 70–80%, the air is present in the form of small spherical air-bubbles surrounded by free water, so-called spherical foam. With larger air content the foam transforms into a so-called polyhedral foam where the water is present in the thin membranes between different air bubbles. The latter foam type means that the foam is very stiff and difficult to handle.

In a foam forming process, spherical foam is normally used, i.e. the air content lies between 40–70%. The small air bubbles function as spacers between different fibres, at the same time as the higher viscosity compared with the water damps the turbulence in the liquid and reduces the collision frequency between various fibres and the flock formation caused hereby. The bubble size in the foam is affected by factors like the type of agitator in the pulper/foam generator 111, the agitation speed, as well as the amount and type of tenside. A suitable average diameter is between 0.02 and 0.2 mm.

In the shown embodiment a mixture of cellulose fibres and synthetic fibres is used. The cellulose fibres in the form of easily defiberizable rolled pulp 110 are metered down into the pulper/foam generator 111 at a controlled speed between a feeding roller pair 112 with combined surface weight meter, whereupon this is conveyed through a pre-wetting channel before it is coarsely shredded down into the pulper 111. The coarse shredding of the pulp occurs e.g. between a so-called spiked roller pair. The pre-wetting of the pulp with fresh water is desirable in order to facilitate the dispersion in the pulper. The pre-wetting channel and the coarse shredder have been omitted from the drawing for the sake of simplicity. In the case that the rolled pulp presents a generally uniform surface weight, the metering can occur merely via the feeding speed. Possible surface weight variations of the rolled pulp can also be compensated by varying the machine speed in the paper machine so that the surface weight of the formed sheet is kept essentially constant.

The synthetic fibres are normally provided in the form of bales 122 which, in a known way, are opened by bale openers 123, metered by means of a corrugated belt 124 and disposed on a collection wire 125. The fibres are sucked from the collection wire through a blow line 126 and metered down into the pulper/foam generator 111 via a condenser 127.

Other equipment for metering the pulp fibres and synthetic fibres than that shown can of course be used.

In the shown embodiment, the same pulper is used for both fibre types, depending on the fact that these can require different processing or where it is desired to use different types of fibre for so-called multi-layer forming, which is described below.

The pulper/foam generator 111 is concentrically located within a larger tank, the foam tank 128. Whilst the pulper 111 is open upwardly, the foam tank 128 is closed. The two vessels communicate with each other via pipes 129, 130 at the bottom and the top.

An intensive dispersion and mixing of the fibres occurs in the pulper/foam generator 111. At the same time, foam is generated with the assistance of the tenside which is in the water. In order to prevent the foam from rising upwardly and forming a growing foam layer on the top, it is important to maintain a foam circulation between the top and bottom of the pulper/foam generator 111. With a suitably designed rotor aggregate 131 a fully formed vortex is obtained, which gives the desired circulation. The pulper volume is adapted in order to be able to even out rapid variations in the fibre metering. A suitable fibre concentration is 0.1–1.5 weight-%.

The air content in the foam can be measured by weighing a known volume of foamed fibre dispersion. This can occur by continually registering the weight of a certain length of the conduit between the pulper/foam generator 111 and the inlet box 117. Calibration of the measurement scale is effected due to the fact that the weight of said volume filled with the liquid in question, without mixing of air, corresponds to 0% air, whilst the same volume filled only with air corresponds to a 100% air content. Adjustment of the air content can occur for example by means of the addition of tenside, the agitation speed in the pulper/foam generator 111 and/or in that compressed air is released into the pump 133.

The foam with included fibres is pumped into the inlet box 117 on a paper machine with the aid of a suitable pump 133, said machine in the shown example being of Fourdrinier-type. The type of paper machine is however of secondary importance for the invention which can also be used on, for instance, suction breast roller machines and double wire machines. The pump should be able to cope with large amounts of air and at the same time be able to handle long synthetic fibres where these are present, without spinning effects occurring. Several different pump types fulfil these requirements. One example is a conventional piston pump. Another is a vacuum pump of the water-ring type, e.g. of the Helivac-make manufactured by Berendsen Teknik AS. An additional example is a pump type manufactured by Discflo Corp., which has a rotating disc pack with radial gaps.

In the depicted embodiment, the inlet box 117 and the suction box 119 can be considered as an integrated unit. The forming of the fibre web is completely closed, i.e. there is no free fluid surface. A dewatered and ready-formed sheet comes out of the inlet box 117.

The foam-fibre dispersion is divided over the width of the machine to the inlet box 117 and fills the space which is delimited by the end walls of the inlet box and the downwardly sloping upper portion. The foam is sucked through the wire 118 with the aid of the vacuum pump 120 and that remaining on the wire becomes the ready-formed sheet.

It is also imaginable to use so-called multi-layer forming with different fibre types/mixtures in different layers. The various fibre types are then fed separately up to the inlet box which, in this case, is of multi-layer type.

In order to maintain the water balance in the system, the water which disappears with the sheet after forming has to be replaced. One way of doing this is by means of a spray 134 across the formed fibre web. The spray 134 serves moreover as a washing zone in order to minimize the content of tenside in the formed sheet before hydroentangling. Addition of the fresh water can also occur at different locations in the system, e.g. at the pre-wetting stage. A separate suction box 135, but one which is coupled to the same circulation stage as above, supplies make-up water to the foam tank 128.

The foam which is sucked through the wire 118 is conveyed via suction box 119 and the vacuum pump 120 to the top of the foam tank 128. An unavoidable amount of leakage air is also conveyed with the foam. The foam tank 128 functions as a buffer tank for the foam.

The foam which is deposited in a vessel will slowly transform from spherical foam into polyhedral foam, said foam types having been described above. In the foam tank 128 the liquid will thus be drained to the bottom of the tank, whilst the lighter foam is accumulated at the top of the tank. The tenside is accumulated in the contact surface between the air and the water. It is therefore likely that the tenside will tend to remain in the lighter foam and thus be concentrated towards the top of the tank.

The liquid phase in the bottom of the foam tank 128 runs over to the pulper 111 via the communicating pipe 129 in the bottom of the tank. In the same way the foam at the top of the foam tank 128 will be forced out via the pipe 130 in the top of the tank due to the over-pressure which is created by the vacuum pump 120. This light foam is very stable and, above all, voluminous and therefore has to be reduced before it is released down into the pulper 111. A high speed propeller 136 mounted in the tube 130 mechanically breaks up the larger air containment and releases a part of the large amount of air which is bound.

A control valve 137 is also arranged in the upper connection pipe 130 between the foam tank 128 and the pulper 111, with the help of which valve the pressure in the foam tank 128 and thereby also the level in the pulper 111 can be kept constant.

By means of the described arrangement, a closed foam loop is obtained which is opened in a controlled manner between the foam tank 128 and the pulper 111. The volume of the foam tank should be dimensioned so that the residence time of the foam in the tank is about 45–180 seconds, preferably 60–120 seconds. A large portion of the liquid content will then be able to drain to the bottom of the tank 128 and thereafter run over to the pulper. At the same time the tank has to be able to contain the lighter foam in the upper part of the tank. A suitable ratio between total volume and the expected liquid volume in the tank is about 4–8, preferably about 6.

The foam thus circulates between the pulper/foam generator 111, the inlet box 117, the wire 118, the suction box 119 and back to the pulper/foam generator 111 via the foam tank 128 in one simple circulation step. A certain addition of tenside and water occurs in order to replace the amount which follows along with the sheet after forming. Make-up water addition can for example be controlled by measuring the differential pressure in the foam tank 128. The tenside content in the foamed fibre dispersion is suitably determined by a surface tension meter.

Figure 2:
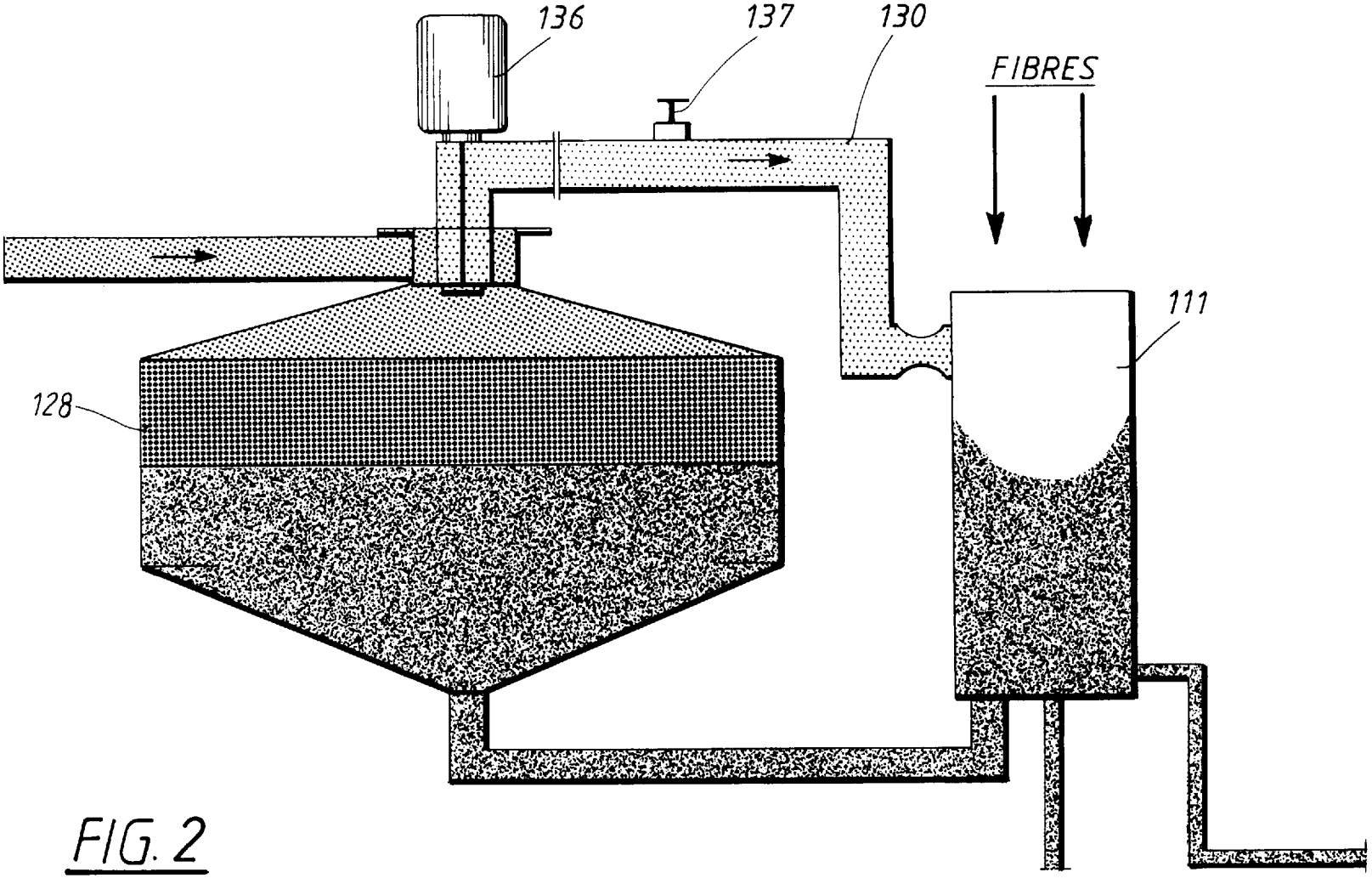
FIG. 2 shows a modified design of the dispersion vessel and the foam tank.

The pulper/foam generator 111 and the foam tank 128 do not of course have to be arranged as an integrated unit, but can be arranged separate from one another as shown in FIG. 2. However, even in this case, they communicate with each other via pipelines 129 and 130. As mentioned above, the system may also comprise two or more pulpers/foam generators which can all still communicate with the same foam tank.

The formed fibre sheet is hydroentangled directly after forming in an entangling station 138, whilst it is still being supported by the wire 118. The entangling station 138 comprises a plurality of rows of nozzles 139, from which very fine water jets under high pressure are directed towards the fibre web and cause an entangling of this, i.e. a tangling together of the fibres. A suitable pressure is adjusted in the entangling nozzles depending on the fibre material, surface weight, etc.

For a further description of hydroentangling—or that which is also called the spunlacing technique, reference is made to i.a. CA-patent 841 938.

The entangled fibre web is dewatered over suction boxes 140 and is then conveyed to a drying station for drying, prior to the final material being rolled up.

The water from the entangling nozzles is removed via suction boxes 140 and pumped to a water purification process, whereupon it is recirculated to the entangling station 138. The described plant is an in-line plant where the foam-formed fibre web which constitutes the base material for the hydroentangling is entangled directly after the foam forming, either by using the same wire 118 as shown in FIG. 1, or with different wires for foam forming and hydroentangling, for example in the case where it is desired to produce a material patterned with holes in connection with hydroentangling. The material is preferably entangled from both sides.

The formation of the foam-formed fibre web can of course occur with other process solutions than the one shown here. Examples of other such processes are disclosed in e.g. GB 1,329,409 and U.S. Pat. No. 4,443,297.

Fibres of many different types and in different mixing ratios can be used. Mixtures of pulp fibres and synthetic fibres, e.g. polyester, polypropylene, rayon, lyocell (viscose), etc., can thus be used. As an alternative to synthetic fibres, natural fibres with long fibre length, over 12 mm, can also be used, such as seed hair fibres, e.g. cotton, kapok and milkweed; leaf fibres, e.g. sisal, abaca, pineapple, New Zealand hemp; and bast fibres, e.g. flax, hemp, ramie, jute, kenaf. Varying fibre lengths can be used and, with a foam forming technique, longer fibres than those which are possible with conventional wet laying of fibre webs can be used. Long fibres, circa 18–30 mm, are advantageous for hydroentangling since they increase the strength of the material, in both wet as well as dry conditions. An additional advantage with foam forming is that it is possible to produce material with lower surface weight than that which is the case with wet laying. As a replacement for pulp fibres, plant fibres with short fibre length can be used, such as esparto grass, phalaris arundinacea and straw from crop seed.

With certain types of fibres, a binder may be desirable in order to give additional strength to the material. Suitable binders include starch-based binders, polyvinyl-alcohol, latex, etc., which are used in order to increase the strength of nonwoven materials.

EXAMPLE 1

A run was made on a Fourdrinier machine having a machine speed of 20 m/min with use of a fibre mixture consisting of 50% pulp fibres of bleached conifer-sulphate and 50% polypropylene fibres 1.4 dtex/18 mm. A fibre dispersion having a fibre concentration of 0.34 weight-% was prepared in a pulper, to which was also added a non-ionic tenside at a concentration of 0.06%. The residence time in the pulper was 34 secs. The air content in the foamed fibre dispersion which was conveyed to the inlet box was 54%. The dry content of the formed fibre web was 30%. Immediately after forming this was subjected to double-sided hydroentangling, i.e. the fibre web was entangled from both sides. The number of entangling strips was 3 pieces/passage. The hole diameter of the nozzles was 120 $\mu$m and the number of holes 1700/m. The entangling pressure was 95 bar. The entangled fibre web was pressed and dried with hot air at 100° C.

The characteristics of the produced material are shown in Table 1.

EXAMPLE 2

A second run was made using a fibre mixture consisting of 70% pulp fibres of bleached sulphate and 30% polypropylene fibres 1.0 dtex/18 mm. The fibre concentration was 0.20 weight-%. The tenside addition was the same as in Example 1. The residence time in the pulper was 40 secs. and the air content in the foamed fibre dispersion which was conveyed to the inlet box was 53%. Entangling was carried out in a manner corresponding to that in Example 1.

The characteristics of the produced material are shown in Table 1.

EXAMPLE 3

A third run was made using a fibre mixture consisting of 50% pulp fibres of bleached conifer-sulphate and 50% Tencel fibres (lyocell) 1.7 dtex/12 mm. The fibre concentration was 0.36 weight-% and the residence time in the pulper 26 secs. The air content of the foamed fibre dispersion which was conveyed to the inlet box was 51%. Entangling was carried out in a manner corresponding to that in Example 1.

The characteristics of the produced material are shown in Table 1.

EXAMPLE 4

An additional run was made using a fibre mixture consisting of 60% pulp fibres of bleached conifer-sulphate and 40% Tencel fibres 1.7 dtex/12 mm. The fibre concentration was 0.18 weight-% and the residence time in the pulper 27 secs. The air content of the foamed fibre dispersion which was conveyed to the inlet box was 49%. Entangling was carried out in a manner corresponding to that in Example 1.

TABLE 1

| | Ex. 1 50/50 pulp/ PP 1.4 × 1 | Ex. 2 70/30 pulp/ PP 1.0 × 18 | Ex. 3 50/50 pulp/ Tencel 1.7 × 12 | Ex. 4 60/40 pulp/ Tencel 1.7 × 12 |
|---|---|---|---|---|
| Surface wt. g/m$^2$ SCAN-P 6:75 | 79 | 43 | 74 | 39 |
| Thickness $\mu$m SCAN-P 47:83 | 486 | 326 | 362 | 299 |

TABLE 1-continued

| | Ex. 1 50/50 pulp/ PP 1.4 × 1 | Ex. 2 70/30 pulp/ PP 1.0 × 18 | Ex. 3 50/50 pulp/ Tencel 1.7 × 12 | Ex. 4 60/40 pulp/ Tencel 1.7 × 12 |
|---|---|---|---|---|
| Fracture extension L % SCAN-P 38:80 | 67 | 22 | 14 | 22 |
| Fracture extension T % SCAN-P 38:80 | 118 | 115 | 42 | 50 |
| Strength in tension dry L N/m SCAN-P 38:80 | 3061 | 1037 | 3036 | 890 |
| Strength in tension dry T N/m SCAN-P 38:80 | 955 | 139 | 711 | 368 |
| Strength in tension wet L N/m SCAN-P 58:86 | 2099 | 128 | 2605 | 350 |
| Strength in tension wet T N/m SCAN-P 58:86 | 358 | 18 | 627 | 174 |
| Absorption 5 secs. g/g SIS 25 12 28 (mod.) | 4.2 | 4.9 | 3.6 | 4.9 |
| Total absorption g/g SIS 25 12 28 (mod.) | 4.2 | 5 | 3.6 | 4.9 |

I claim:

1. Method of producing a nonwoven material for use in hydroentangling of a fibre web, said method comprising the steps of:

metering dry fibres, natural and/or synthetic, into a dispersion vessel, the fibres being dispersed in a foamable liquid comprising water and a tenside for forming a foamed fibre dispersion, applying the foamed fibre dispersion to a wire in a closed and, during forming, foam-filled forming unit, and recirculating the foamable liquid, after passing through the wire, to the dispersion vessel in a simple closed circuit via a closed foam tank in which the foamable liquid is separated into a liquid phase and a lighter foam phase, wherein liquid from the bottom of the foam tank is led to the dispersion vessel via a first pipeline and the foam pass to the dispersion vessel via a second pipeline in the top of the foam tank, wherein fibres are added to the dispersion vessel and dispersed in he foamable liquid, and wherein the pressure in the foam tank is kept substantially constant.

2. Method according to claim 1, further comprising adding, apart from the fibres, only fresh water, air, and tenside to the closed circuit of the carrier medium, in order to replace the amount which has left the closed circuit with the fibre or paper web after forming.

3. Method according to claim 2, characterized in that the fresh water is sprayed on to the formed fibre web before hydroentangling, and in that it is supplied to the closed circuit via a suction box after having passed through the fibre web.

4. Method according to claim 2, further comprising adding fibre furnish additives to the closed circuit of the carrier medium.

5. Method according to claim 4 wherein the fibre furnish additives are selected from the group consisting of wet-strengtheners, binders, and creping chemicals.

6. Method according to claim 1, wherein the pressure in the foam tank is kept substantially constant by means of a regular valve arranged in, or directly after, said second pipeline.

7. Method according to claim 6, characterized in that the foam in, or close to, said second pipeline is acted upon mechanically, so that larger air bubbles in the foam are broken up, whereby bound air is released from the foam.

8. Nonwoven material produced according to the method defined in claim 1.

9. Nonwoven material according to claim 8, characterized in that its fibres are constituted by natural fibres or mixtures of natural fibres and synthetic fibres.

10. Nonwoven material according to claim 9, characterized in that natural fibres with a length greater than 12 mm are included in the material.

11. Method according to claim 1 wherein residence time of the fibres in the dispersion vessel is between 45–180 seconds.

12. Method according to claim 1 wherein said metering step includes metering the dry fibres into a dispersion vessel after pre-wetting.

* * * * *